US005644934A

United States Patent [19]

Pompl

[11] Patent Number: 5,644,934

[45] Date of Patent: Jul. 8, 1997

[54] PROCESS AND DEVICE FOR LOW-TEMPERATURE SEPARATION OF AIR

[75] Inventor: Gerhard Pompl, Munich, Germany

[73] Assignee: Linde Aktiengesellchaft, Wiesbaden, Germany

[21] Appl. No.: 566,701

[22] Filed: Dec. 4, 1995

[30] Foreign Application Priority Data

Dec. 5, 1994 [DE] Germany ..... 44 43 190.2

[51] Int. Cl.[6] ..... F25J 3/04

[52] U.S. Cl. ..... 62/647; 62/654; 62/924

[58] Field of Search ..... 62/647, 654, 924

[56] References Cited

U.S. PATENT DOCUMENTS

| | | | |
|---|---|---|---|
| 4,555,256 | 11/1985 | Skolaude et al. . | |
| 5,019,145 | 5/1991 | Tohde et al. . | |
| 5,049,173 | 9/1991 | Cormier, Sr. et al. | 62/924 X |
| 5,108,476 | 4/1992 | Dray et al. | 62/924 X |
| 5,159,816 | 11/1992 | Kovak et al. | 62/924 X |
| 5,245,831 | 9/1993 | Agrawal et al. . | |
| 5,349,824 | 9/1994 | Ha et al. | 62/924 X |
| 5,426,946 | 6/1995 | Corduan et al. . | |
| 5,440,884 | 8/1995 | Bonaquist et al. | 62/924 X |
| 5,469,710 | 11/1995 | Howard et al. | 62/924 X |
| 5,522,224 | 6/1996 | Canney | 62/924 X |
| 5,546,766 | 8/1996 | Higginbotham | 62/924 X |

FOREIGN PATENT DOCUMENTS

| | | |
|---|---|---|
| 0171711 | 2/1986 | European Pat. Off. . |
| 0341854 | 11/1989 | European Pat. Off. . |

*Primary Examiner*—Christopher Kilner

*Attorney, Agent, or Firm*—Millen, White, Zelano, & Branigan, P.C.

[57] ABSTRACT

The process and the device are used for low-temperature separation of air. A first split stream of compressed and purified air is cooled, fed to a main rectifying system and separated there into liquid oxygen and gaseous nitrogen. A liquid product fraction (for example, oxygen and/or nitrogen) is vaporized in indirect heat exchange with a second split stream of compressed and purified air. The second split stream condenses during indirect heat exchange at least partially. At least a portion of the second split stream, downstream from indirect heat exchange with the liquid product fraction, is used as cooling medium for top cooling of a crude argon column downstream from the main rectifying system. The second split stream makes available all or essentially all the cold needed for liquefaction of crude argon. Preferably, at least a portion of the second split stream, vaporized in the indirect heat exchange in the top condenser of the crude argon column, is fed without further pressure increase to the main rectifying system.

26 Claims, 1 Drawing Sheet

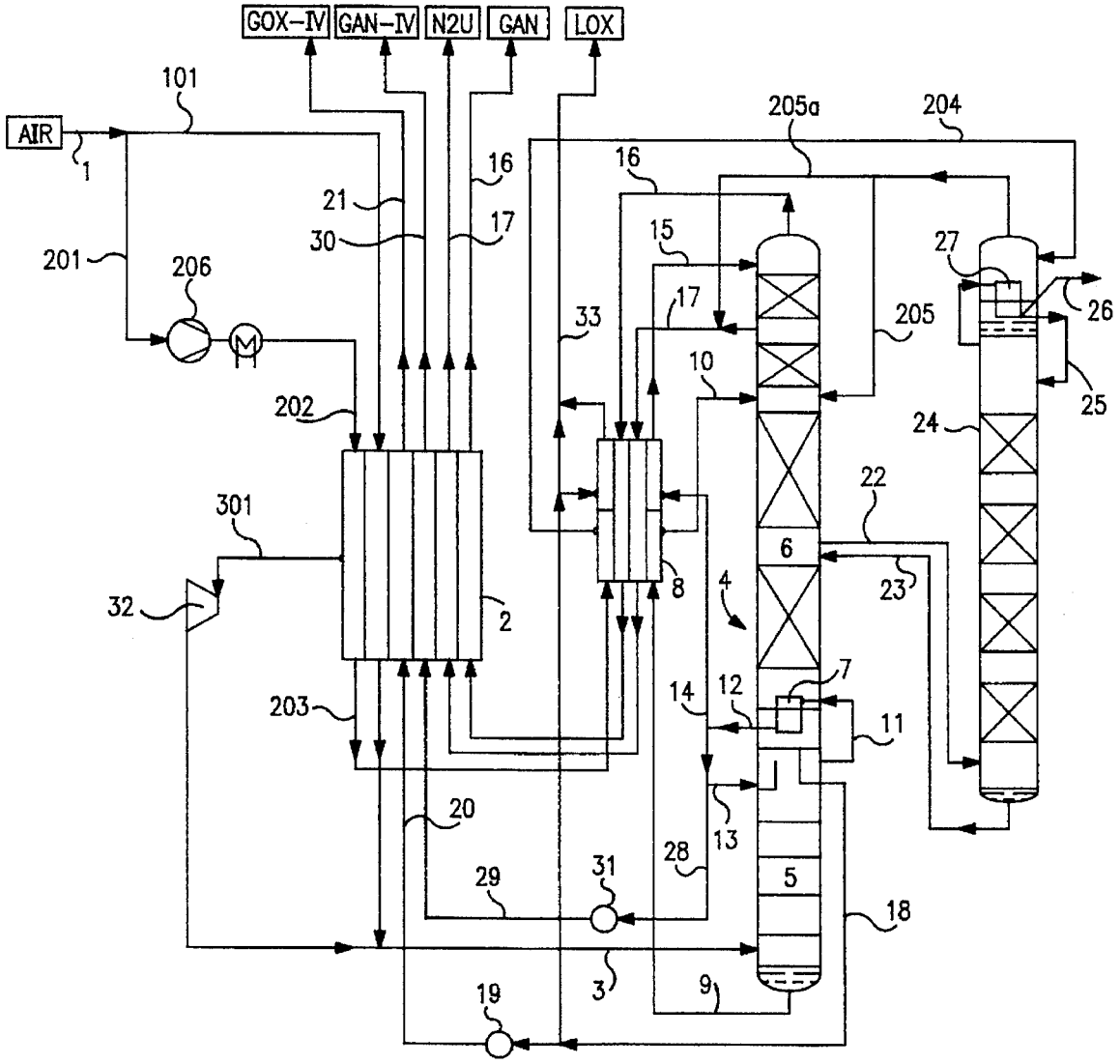
GOX-IV
GAN-IV
N2U
GAN
LOX
AIR
101
1
201
206
21
30
16
17
202
301
32
2
203
20
29
31
3
19
33
16
15
17
10
8
4
6
7
14
12
11
13
28
5
9
18
205a
204
205
27
26
25
24
22
23

PROCESS AND DEVICE FOR LOW-TEMPERATURE SEPARATION OF AIR

SUMMARY OF THE INVENTION

The invention relates to a process and a device for low temperature separation of air, in which a first split stream of compressed and purified air is cooled, fed to a main rectifying system and separated there into liquid oxygen and gaseous nitrogen. In a first condenser-vaporizer, a liquid product fraction, in indirect heat exchange with a second split stream of compressed and purified air, vaporizes. The second split stream, during the indirect heat exchange in the first condenser-vaporizer, condenses at least partially. An argon-containing oxygen fraction from the main rectifying system is fed to a crude argon column and is split therein into crude argon and an oxygen-rich residual liquid. Vaporous crude argon from the top of the crude argon column is liquefied by indirect heat exchange in a second condenser-vaporizer in which at least a portion of the second split stream is vaporized downstream from the first condenser-vaporizer.

The fundamentals of low-temperature air separation and argon recovery subsequent to it are described in Hausen/Linde, Tieftemperaturtechnik [Cryogenics], second edition, 1985, especially on pages 332 to 334. The main rectifying system of an air separator in which oxygen and nitrogen are recovered comprises at least one, often two, rectifying columns. Processes with vaporization of a product fraction recovered as a liquid are shown in EP-A-341854 31854 (see also U.S. Pat. No. 4,871,382) and EP-B-93448 (see also U.S. Pat. No. 4,555,256). In most known processes, the air condensed (often completely or almost completely) against the vaporizing oxygen is fed as a liquid to one of the rectifying columns. Because of its composition, this must occur at a middle level of the column, i.e., above the bottom and below the top. This feeding of liquid at an intermediate level disrupts the rectifying and leads to a decrease in product purity and/or yield.

In U.S. Pat. No. 5,245,831 (FIG. 4), the proposal was made to make available, by liquefied feed air, a portion of the cold needed to cool the crude argon column. In any case, the procedure described in U.S. Pat. No. 5,245,831 requires the use of two condenser-vaporizers at the crude argon column and is thus very expensive from the point of view of equipment and control technology. Further, the vaporized air is again warmed up, fed back to the air compressor and compressed and purified a second time, so that the main heat exchanger, compressor and molecular sieve unit are made correspondingly large (e.g., the main heat exchanger must have additional passes) and additional energy is consumed.

Thus, an object of the invention is to provide a process and apparatus of the above-mentioned type which is especially economically and, in particular, achieves an especially high product purity and/or an especially high product yield with an especially low expense for equipment and operating technology and/or with especially low energy consumption.

Upon further study of the specification and appended claims, further objects and advantages of this invention will become apparent to those skilled in the art.

These objects are achieved in a first embodiment of the invention by making all, or essentially all, of the cold (refrigeration) needed to liquefy the crude argon available by the vaporization of a second split air stream.

The amount of cold needed to liquefy crude argon corresponds at least to the heat of vaporization of the reflux amount for the crude argon column. If crude argon is to be withdrawn from the crude argon column as a liquid, the total amount of cold used to liquefy crude argon will in addition include the amount of cold needed to liquefy the product amount, if product liquefaction is to occur in the above-mentioned second condenser-vaporizer. Alternatively to using the second split air stream for product liquefaction (preferably in the second condenser-vaporizer) crude argon product can be liquefied by a different refrigeration fluid (preferably in a separate condenser).

Herein, "essentially all" means at least 90%, preferably at least 95%, most preferably at least 99% of this amount of cold. The remaining amount of cold can be generated, for example, by supplying a small amount of another liquid fraction (e.g., bottom or intermediate liquid from one of the columns) to the vaporization side of the second condenser-vaporizer. In accordance with the invention, preferably a single heat exchanger is used as the second condenser-vaporizer. In terms of equipment it can also be achieved by more than one heat exchange block wherein the vaporization spaces can communicate with one another.

In the first embodiment of the invention, only a single condenser-vaporizer is needed to cool the crude argon column. Simultaneously, the cold of the condensed air—inexpensive compared to vaporization of separation products—can be used to liquefy the crude argon. Additionally, only a little or no liquid air need be fed to the rectifying column(s). The portion of total amount of feed air introduced into the process that is delivered to the rectifying system as liquid air is preferably 0 to 15 vol.%, especially about 0.3 to 5 vol.%. Also, high product yield and purity are achieved. (Vice versa, it is of course possible, compared to a corresponding process with feeding of liquid air into the column, to keep yield and purity constant and instead reduce the number of theoretical plates, i.e., to save investment costs.)

Further, the nitrogen content of the liquefied air in the second split stream is higher than that in the bottom liquid that comes from one of the columns of the main rectifying system, which is usually the stream vaporized in the top condenser of the crude argon column. Thus, the top of the crude argon column can be operated at a lower pressure, preferably about 1.10 to 1.20 bar, especially about 1.15 bar. With pressure loss remaining the same per theoretical plate, the separation performance of the crude argon column can be improved, or (more economical) material exchange elements with higher pressure loss per theoretical plate can be used and still a large separation effect can be achieved. For example, it is possible with the help of the invention to achieve, with conventional sieve plates, theoretical plate numbers of more than 120, for example, 120 to 165, in the crude argon column and in doing so to achieve an oxygen content of less than 10 ppm, preferably as low as 1 ppm.

The objects described above can also be achieved in accordance with a second embodiment of the invention wherein at least a portion of the second split air stream, vaporized during the indirect heat exchange in the second condenser-vaporizer is introduced, without further pressure increase, into the main rectifying system. Preferably, even the largest portion of the vaporized second split air stream or the entire vaporized second split air stream is fed to the, or one of, the rectifying columns of the main rectifying system. Preferably, the amount of vaporized second split air stream that is fed to the main rectifying system is about 80 to 100%, especially 95 to 100%.

Thus, preliminary work already performed on this air stream (compression, purification, cooling) is not lost to the separation process. Vice versa, the feeding of a vaporized stream does not represent as great a disruption to rectification as does the feeding of a liquid. Thus, in comparison to U.S. Pat. No. 5,245,831, there is an increase in efficiency.

In both embodiments of the invention, the liquid product fraction that undergoes indirect heat exchange with the second split air stream in the first condenser-vaporizer can be formed from each air component individually or by a mixture of air constituents, for example, by oxygen, by nitrogen or by an intermediate product, such as crude argon, containing argon and oxygen. Of course, it is possible to vaporize several liquid product fractions (for example, fractions of different composition and/or different pressure) against the second split air stream. The liquid can be withdrawn, for example, from a rectifying column or a storage or buffer tank. The main heat exchanger, wherein gaseous products are warmed up against feed air, or a separate heat exchanger (side-stream condenser), can be used as the first condenser-vaporizer.

The invention can advantageously be used in a double-column process, i.e., wherein the main rectifying system has a high-pressure column and a low-pressure column. Here, the first split air stream is fed to the high-pressure column and an argon-containing oxygen fraction is withdrawn from the low-pressure column. Preferably, the liquid product fraction used to condense the second split air stream in the first condenser-vaporizer is formed by a liquid oxygen stream from the low-pressure column.

A combination of the features of both variants of the invention also combines their advantages. For example, the majority of or the entire liquefied second split air stream can be introduced into the second condenser-vaporizer, and the vapor generated in it can be fed partially or completely to a rectifying column (for example, the low-pressure column of a double column).

If gaseous product, for example, gaseous oxygen, is to be recovered under increased pressure, it is advantageous if the pressure of the liquid product fraction is increased upstream from the indirect heat exchange with the second split air stream. In this way the compression of the gaseous product can be entirely or partially eliminated. Overall, because of the so-called internal compression, one or more compressed products such as compressed oxygen, compressed nitrogen and/or crude argon under pressure are generated in an especially economical way.

Here, it is advantageous if the second split air stream, during the indirect heat exchange with the liquid oxygen product stream, is under a pressure that is higher than the highest pressure in the main rectifying system, for example, under a supercritical pressure. The liquefaction temperature of the air condensing against the vaporizing product fraction can thus be matched to the vaporization temperature of the product fraction. Preferably, the second split air stream is at a pressure of about 30 to 55 bar, especially about 45 to 52 bar, higher than the highest pressure achieved in the main rectification system.

There are basically two variants for the compression of air to the high pressure. Either all of the separated air is compressed to the higher pressure and the portion of air not needed to vaporize the liquid product is expanded to the pressure of the rectifying column(s), for example producing work; or all the air is brought only to the pressure needed for introduction into the rectifying column(s) and only a portion of the air, that includes the second split air stream, is recompressed to the higher pressure. A portion of the recompressed air can also be used in this case to generate cold by work-producing expansion. In both cases, the pressure energy in the second split stream can also be partially recovered in a work-producing expansion (see EP-B-93448).

It is advantageous if at least about 21%, preferably about 21 to 30 mol %, especially 22 to 25 mol %, of the amount of feed air is withdrawn from the main rectifying system in liquid form. The portion is relative to the standard volume. This withdrawal in liquid form can be performed by removal from the rectifying column(s) in the liquid state and subsequent external vaporization, preferably under pressure (e.g., vaporization of the liquid product fraction in the first condenser-vaporizer), as well as by withdrawal as a liquid product, for example for storage in tanks. The portion of 21% can be achieved, for example, by vaporizing the entire oxygen product in the first condenser-vaporizer and then recovering a small amount of nitrogen and/or oxygen as liquid product.

Preferably, a third split air stream of compressed and purified air is expanded, producing work, and is fed to the main rectifying system.

The third split air stream can be branched, for example, from the second split air stream, preferably downstream from a re-compressor that brings the second split air stream to a pressure above the maximum pressure of the main rectifying system. For the case in which all the air is compressed to this higher pressure, the third split air stream can also be branched from the first split air stream, or even be identical to the first split air stream. In the case of a double column process, the expanded third split air stream is preferably fed to the high-pressure column.

Alternatively, the work-producing expansion of the third split air stream (for example, after branching from the first split air stream) can also go from about the pressure of the high-pressure column to the pressure of the low-pressure column; the expanded air is then fed to the low-pressure column.

Another liquid product stream can be vaporized in an advantageous way in indirect heat exchange with compressed and purified air. For example, in addition to a main amount of oxygen product, a smaller liquid stream of nitrogen and/or crude argon can exchange latent heat with condensing air, e.g., the second split air stream.

The invention further relates to an apparatus for low-temperature air separation comprising:

a main rectification system having at least one rectification column;

a first air line and a second air line, both connected to a source of compressed and purified air, the first line being connected to the main rectification system and the second line being connected to the liquefaction space of a first condenser-vaporizer;

a liquid line connected to a source of a liquid product fraction and connected to the vaporization space of the first condenser-vaporizer;

a crude argon column that is connected to the main rectification system and connected to the liquefaction space of a second condenser-vaporizer; and the second air line is connected downstream from the first condenser-vaporizer to the vaporization space of the second condenser-vaporizer;

wherein the second condenser-vaporizer forms the only top condenser for the crude argon column.

According to a further embodiment, the apparatus in accordance with the invention comprises:

a main rectification system having at least one rectification column;

a first air line and a second air line, both connected to a source of compressed and purified air, the first line being connected to the main rectification system and the second line being connected to the liquefaction space of a first condenser-vaporizer;

a liquid line connected to a source of a liquid product fraction and connected to the vaporization space of the first condenser-vaporizer;

a crude argon column that is connected to the main rectification system and connected to the liquefaction space of a second condenser-vaporizer;

the second air line is connected downstream from the first condenser-vaporizer to the vaporization space of the second condenser-vaporizer; and a vapor line connects the vaporization space of the second condenser-vaporizer to the main rectification system, the vapor line contains no devices for increasing pressure.

BRIEF DESCRIPTION OF THE DRAWING

Various other objects, features and attendant advantages of the present invention will be more fully appreciated as the same becomes better understood when considered in conjunction with the accompanying drawing, wherein:

FIG. 1 is a schematic illustration of an embodiment in accordance with the invention.

DETAILED DESCRIPTION

A feedstream of compressed and purified air is fed to the air separation system via line 1. A first split stream 101 of the compressed and purified air 1 is cooled to about the dew-point under a pressure of preferably about 5 to 10 bars, especially 5.5 to 6.5 bars, in a main heat exchanger 2 by indirect heat exchange with product streams. The main rectifying system has a double column 4 with high-pressure column 5 (preferably about 5 to 10 bars, especially 5.5 to 6.5 bars), low-pressure column 6 (preferably about 1.3 to 2 bars, especially 1.5 to 1.7 bars) and condenser 7 placed between them. Bottom liquid 9 from high-pressure column 5 is supercooled in a countercurrent heat exchanger 8 against product streams from low-pressure column 6 and then fed to low-pressure column 6 (line 10). Gaseous nitrogen 11 from the top of high-pressure column 5 is liquefied in condenser 7 against vaporizing liquid in the bottom of low-pressure column 6. Part of condensate 12 is fed as reflux to high-pressure column 5 (line 13) and another part 14, after supercooling in heat exchanger 8, is fed (line 15) to low-pressure column 6. After withdrawal from low-pressure column 6, low-pressure nitrogen 16 and impure nitrogen 17 are warmed up in heat exchangers 8 and 2 to about ambient temperature.

Product oxygen is withdrawn as liquid oxygen stream 18 from the bottom of low-pressure column 6 and is brought by a pump 19 to an increased pressure of, for example, about 5 to 80 bars, depending on the needed product pressure. (Of course other methods to increase the pressure in the liquid phase can be used, for example by exploiting a hydrostatic potential or by vaporization under pressure buildup at a storage tank.) Liquid high-pressure oxygen 20 is vaporized in main heat exchanger 2 and withdrawn as internally compressed gaseous product 21.

Against the vaporizing product stream, a second split stream 201, 202 of compressed and purified air is condensed after it has been brought, in a re-compressor 206, to a pressure of preferably about 12 to 60 bars, especially 15 to 40 bars.

An argon-containing oxygen fraction 22 from low-pressure column 6 is separated in a crude argon column 24 into crude argon at the top of column 24 and an oxygen-rich residual liquid. The latter is fed back by line 23, optionally conveyed by a pump, to low-pressure column 6. To generate reflux 25 and optionally to recover liquid crude argon 26, the gaseous crude argon is liquefied in a top condenser 27 by indirect heat exchange. (Alternatively or additionally, the crude argon product can be withdrawn as a gas.) In the framework of the invention, variants for argon-oxygen separation other than those represented in the drawing are possible, especially the one shown in DE-A-4317916, U.S. Pat. No. 5,426,946, and EP-A-628777. For other details on argon recovery by air separation, see EP-B-377177 and U.S. Pat. No. 5,019,145 and the older applications DE 4406051 (see also U.S. Ser. No. 08/393,388), DE 4406049 (see also U.S. Ser. No. 08/393,389) and DE 4406069 (see also U.S. Ser. No. 08/393,389).

According to the invention, liquefied second split stream 203/204 is fed to the crude argon column on the vaporization side of top condenser 27 and vaporized there. Generally, the second split stream is supercooled in advance in countercurrent heat exchanger 8 and throttled (e.g., by an expansion valve (not shown)) to about the pressure of the low-pressure column 6. The vapor produced in the indirect heat exchange with crude argon is fed by line 205 to low-pressure column 6 and/or by 205*a* to product line 17 for impure nitrogen.

In addition, another liquid product can be recovered by vaporization. In the example of the drawing, liquid nitrogen is conveyed out of the high-pressure column 5 by lines 28 and 29 to main heat exchanger 2 and withdrawn by line 30 as gaseous product. The liquid nitrogen can, if needed, be internally compressed, for example by a pump 31.

Also coming into play as an additional liquid product that is vaporized against highly compressed air is, for example, liquid crude argon that is needed in a gaseous state under increased pressure. Crude argon can—just like the nitrogen and oxygen streams to be vaporized—be withdrawn either from one column or from a buffer or storage tank. The invention is especially applicable to internal compression of crude argon according to EP-A-171711, EP-B-331028 (see also U.S. Pat. No. 4,935,044) or EP-B-363861 (see also U.S. Pat. No. 4,932,212).

In vaporizing several internally compressed product streams 20, 29, the pressure of the condensing air must, in principle, conform to the highest vaporization temperature. For the case in the embodiment in which the vaporization temperature of internally compressed nitrogen 29 is higher than that of internally compressed oxygen 20, but the amount of liquid nitrogen to be vaporized is clearly less than the amount of liquid oxygen, it is possible to adapt the air pressure to the lower of the two vaporization temperatures.

For an especially preferred embodiment the following numerical values are valid:

| | Pressure in bars |
|---|---|
| Air pressure (line 1) | 6.50 |
| Second split stream 202/203 | 58.00 |
| High-pressure column 5 | 6.20 |
| Low-pressure column 6 | 1.60 |

-continued

| | Pressure in bars |
|---|---|
| Top of crude argon column 24 | 1.05 |
| Vaporization side of crude argon condenser 27 | 1.40 |
| Internally compressed oxygen (line 20) | 20.00 |
| Internally compressed nitrogen (line 29) | 25.00 |

The vaporization of the liquid product(s) against the second split stream of air can also be performed, different from the representation in the drawing, in one or more side-stream condensers that are separate from the main heat exchanger 2.

Part of the oxygen product can be recovered as a liquid product (line 33); it is also possible to withdraw a certain amount of oxygen in the gaseous state from low-pressure column 6 and to warm it up in main heat exchanger 2 (not represented in the drawing).

To generate process cold, a third split stream 301 can be branched from recompressed second split stream 202, expanded to produce work (turbine 32) and fed to the main rectifying system, preferably to high-pressure column 5 via line 3.

The second split air stream 203 is preferably about 35 to 45 mol %, especially about 35 to 40 mol % of feedstream 1. The third split air stream 301 is preferably about 0 to 45 mol %, especially about 15 to 40 mol % of feedstream 1. The first split air stream represents the remainder of feedsteam 1.

Further, in FIG. 1, the symbols associated with lines 16, 17, 21 30 and 33 are identified as follows: GOX-IV: gaseous oxygen—innenverdichtet (internally pressurized) GAN-IV: gaseous nitrogen—innenverdichtet (internaly pressurized) N2U: nitrogen—unrein (impure) GAN: gaseous nitrogen LOX: liquid oxygen Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 44 43 190.2, filed Dec. 5, 1994, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for low-temperature separation of air comprising:

cooling a first stream of compressed and purified air, feeding said first stream to a main rectification system comprising at least one rectification column, wherein said first stream is separated into liquid oxygen and gaseous nitrogen;

vaporizing a liquid product fraction in a first condenser-vaporizer by indirect heat exchange with a second stream of compressed and purified air;

at least partially condensing said second stream by indirect heat exchange in said first condenser-vaporizer;

feeding an argon-containing oxygen fraction removed from said main rectification system to a crude argon column and separating said argon-containing oxygen fraction into a vaporous crude argon stream and an oxygen-rich residual liquid;

liquefying said vaporous crude argon of said crude argon column by indirect heat exchange in a second condenser-vaporizer with said second stream downstream of said first condenser-vaporizer, whereby at least a portion of said second stream is vaporized;

wherein all, or essentially all, of the refrigeration needed for liquefaction of crude argon is produced by vaporization of said second stream.

2. A process for low-temperature separation of air comprising:

cooling a first stream of compressed and purified air, feeding said first stream to a main rectification system comprising at least one rectification column, wherein said first stream is separated into liquid oxygen and gaseous nitrogen;

vaporizing a liquid product fraction in a first condenser-vaporizer by indirect heat exchange with a second stream of compressed and purified air;

at least partially condensing said second stream by indirect heat exchange in said first condenser-vaporizer;

feeding an argon-containing oxygen fraction removed from said main rectification system to a crude argon column wherein said argon-containing oxygen fraction is separated into a vaporous crude argon and an oxygen-rich residual liquid;

liquefying said vaporous crude argon of said crude argon column by indirect heat exchange in a second condenser-vaporizer with said second stream downstream of said first condenser-vaporizer, whereby at least a portion of said second stream is vaporized;

wherein at least a portion of said second stream vaporized during indirect heat exchange in said second condenser-vaporizer is fed, without further pressure increase, to said main rectification system.

3. A process according to claim 1, wherein at least a portion of said second stream vaporized during indirect heat exchange in said second condenser-vaporizer is fed, without further pressure increase, to said main rectification system.

4. A process according to claim 1, wherein said liquid product fraction is a liquid oxygen stream removed from said main rectification system.

5. A process according to claim 2, wherein said liquid product fraction is a liquid oxygen stream removed from said main rectification system.

6. A process according to claim 3, wherein said liquid product fraction is a liquid oxygen stream removed from said main rectification system.

7. A process according to claim 4, wherein said main rectification system comprises a dual column having a high-pressure column and a low-pressure column, and said liquid oxygen stream is removed from said low-pressure column.

8. A process according to claim 5, wherein said main rectification system comprises a dual column having a high-pressure column and a low-pressure column, and said liquid oxygen stream is removed from said low-pressure column.

9. A process according to claim 6, wherein said main rectification system comprises a dual column having a high-pressure column and a low-pressure column, and said liquid oxygen stream is removed from said low-pressure column.

10. A process according to claim 1, wherein the pressure of said liquid product fraction is increased prior to said indirect heat exchange with said second stream.

11. A process according to claim 2, wherein the pressure of said liquid product fraction is increased prior to said indirect heat exchange with said second stream.

12. A process according to claim 1, wherein said second stream, during said indirect heat exchange with said liquid product fraction, is under a pressure that is higher than the highest pressure in said main rectification system.

13. A process according to claim 2, wherein said second stream, during said indirect heat exchange with said liquid product fraction, is under a pressure that is higher than the highest pressure in said main rectification system.

14. A process according to claim 1, wherein at least 21% of the total amount of compressed and purified air fed to said process is withdrawn from said main rectification system in liquid form.

15. A process according to claim 2, wherein at least 21% of the total amount of compressed and purified air fed to said process is withdrawn from said main rectification system in liquid form.

16. A process according to claim 1, wherein a third stream of compressed and purified air is expanded, producing work, and fed to said main rectification system.

17. A process according to claim 2, wherein a third stream of compressed and purified air is expanded, producing work, and fed to said main rectification system.

18. A process according to claim 1, further comprising vaporizing another liquid product stream, in addition to said liquid product stream, by indirect heat exchange with compressed and purified air.

19. A process according to claim 2, further comprising vaporizing another liquid product stream, in addition to said liquid product stream, by indirect heat exchange with compressed and purified air.

20. A process according to claim 9, wherein the pressure of said liquid product fraction is increased prior to said indirect heat exchange with said second stream.

21. A process according to claim 20, wherein said second stream, during said indirect heat exchange with said liquid product fraction, is under a pressure that is higher than the highest pressure in said main rectification system.

22. An apparatus for low-temperature separation of air comprising:

a main rectification system having at least one rectification column;

a first air line and a second air line, both connected to a source of compressed and purified air, said first line being connected to said main rectification system and said second line being connected to the liquefaction space of a first condenser-vaporizer;

a liquid line connected to a source of a liquid product fraction and connected to the vaporization space of said first condenser-vaporizer;

a crude argon column that is connected to said main rectification system and connected to the liquefaction space of a second condenser-vaporizer; and said second air line is connected downstream from said first condenser-vaporizer to the vaporization space of said second condenser-vaporizer;

wherein said second condenser-vaporizer forms the only condenser for condensing vaporous crude argon from said crude argon column.

23. An apparatus for low-temperature separation of air comprising:

a main rectification system having at least one rectification column;

a first air line and a second air line, both connected to a source of compressed and purified air, said first line being connected to said main rectification system and said second line being connected to the liquefaction space of a first condenser-vaporizer;

a liquid line connected to a source of a liquid product fraction and connected to the vaporization space of said first condenser-vaporizer;

a crude argon column that is connected to said main rectification system and connected to the liquefaction space of a second condenser-vaporizer;

said second air line is connected downstream from said first condenser-vaporizer to the vaporization space of said second condenser-vaporizer; and a vapor line connects the vaporization space of said second condenser-vaporizer to said main rectification system, said vapor line contains no devices for increasing pressure.

24. An apparatus according to claim 20, further comprising a vapor line that connects the vaporization space of said second condenser-vaporizer to said main rectification system, wherein said vapor line contains no devices for increasing pressure.

25. A process for low-temperature separation of air comprising:

cooling a first stream of compressed and purified air, feeding said first stream to a main rectification system wherein said first stream is separated into liquid oxygen and gaseous nitrogen, said main rectification system comprising a double column having a high pressure column and a low-pressure column and wherein said first stream of compressed and purified air is fed into said high pressure column;

vaporizing a liquid product fraction in a first condenser-vaporizer by indirect heat exchange with a second stream of compressed and purified air;

at least partially condensing said second stream by indirect heat exchange in said first condenser-vaporizer;

feeding an argon-containing oxygen fraction removed from said main rectification system to a crude argon column and separating said argon-containing oxygen fraction into a vaporous crude argon stream and an oxygen-rich residual liquid;

liquefying said vaporous crude argon of said crude argon column by indirect heat exchange with said second stream downstream of said first condenser-vaporizer, whereby at least a portion of said second stream is vaporized in a second condenser-vaporizer;

wherein all, or essentially all, of the refrigeration needed for liquefaction of crude argon is produced by vaporization of said second stream.

26. A process for low-temperature separation of air comprising:

cooling a first stream of compressed and purified air, feeding said first stream to a main rectification system wherein said first stream is separated into liquid oxygen and gaseous nitrogen, said main rectification system comprising a double column having a high-pressure column and a low-pressure column and wherein said first stream of compressed and purified air is fed into said high pressure column;

vaporizing a liquid product fraction in a first condenser-vaporizer by indirect heat exchange with a second stream of compressed and purified air;

at least partially condensing said second stream by indirect heat exchange in said first condenser-vaporizer and separating said second stream into a third stream of compressed and purified air and a fourth stream of compressed and purified air;

introducing said third stream of compressed and purified air into said high-pressure column;

feeding an argon-containing oxygen fraction removed from said main rectification system to a crude argon column and separating said argon-containing oxygen fraction into a vaporous crude argon stream and an oxygen-rich residual liquid;

liquefying said vaporous crude argon of said crude argon column by indirect heat exchange with said fourth stream downstream of said first condenser-vaporizer, whereby at least a portion of said fourth stream is vaporized in a second condenser-vaporizer;

wherein all, or essentially all, of the refrigeration needed for liquefaction of crude argon is produced by vaporization of said fourth stream.

* * * * *